US008397542B2

(12) United States Patent
Tokumoto et al.

(10) Patent No.: US 8,397,542 B2
(45) Date of Patent: Mar. 19, 2013

(54) PILE KNITTED FABRIC AND SEWN PRODUCT EMPLOYING PILE KNITTED FABRIC

(75) Inventors: Hiroyuki Tokumoto, Hyogo (JP); Kazuya Kusunoki, Hyogo (JP)

(73) Assignee: Kaneka Corporation, Osaka-shi (JP)

( * ) Notice: Subject to any disclaimer, the term of this patent is extended or adjusted under 35 U.S.C. 154(b) by 38 days.

(21) Appl. No.: 13/201,798

(22) PCT Filed: Feb. 18, 2009

(86) PCT No.: PCT/JP2009/052800

§ 371 (c)(1), (2), (4) Date: Aug. 16, 2011

(87) PCT Pub. No.: WO2010/095223

PCT Pub. Date: Aug. 26, 2010

(65) Prior Publication Data

US 2011/0296875 A1 Dec. 8, 2011

(51) Int. Cl.
*D04B 9/14* (2006.01)

(52) U.S. Cl. ..... 66/191; 66/194; 66/202

(58) Field of Classification Search ..... 66/169 R, 66/170, 190, 191, 194, 202
See application file for complete search history.

(56) References Cited

U.S. PATENT DOCUMENTS 2,903,708 A * 9/1959 Cole ..... 428/95
3,010,179 A * 11/1961 Thal ..... 28/160
3,669,818 A * 6/1972 Stark ..... 428/88

(Continued)

FOREIGN PATENT DOCUMENTS

CN 2144662 Y 10/1993
EP 2 093 317 A1 8/2009

(Continued)

OTHER PUBLICATIONS

Russian Decision on Grant mailed Jul. 5, 2012, issued in corresponding Russian Patent Application No. 2011138237/12(057065), (7 pages). With English Translation.

(Continued)

*Primary Examiner* — Danny Worrell
(74) *Attorney, Agent, or Firm* — Westerman, Hattori, Daniels & Adrian, LLP

(57) ABSTRACT

Disclosed is a pile knitted fabric containing a ground structure and a pile fiber napped from the ground structure. The pile knitted fabric includes a pile fiber that is knitted into a stitch of the ground structure and napped therefrom; and a stitch composed only of the ground structure, wherein a pile length of the pile knitted fabric is 6 to 25 mm, a continuous length of a pile fiber portion where the pile fiber is knitted into the stitch of the ground structure and napped therefrom is 10 mm or more, a width of a line of a stitch pattern composed only of the ground structure is 1 to 6 mm, a continuous length of the line of the stitch pattern composed only of the ground structure is 10 mm or more, a ratio of the width of the line of the stitch pattern composed only of the ground structure to the pile length is 0.09 to 0.30, and when a weft direction of the pile knitted fabric is placed horizontally, an acute angle formed between the weft direction of the pile knitted fabric and the line of the stitch pattern composed only of the ground structure is 20° to 90°.

13 Claims, 13 Drawing Sheets

U.S. PATENT DOCUMENTS

| | | | | |
|---|---|---|---|---|
| 3,997,946 | A * | 12/1976 | Hergert | 26/2 R |
| 4,172,165 | A * | 10/1979 | Kieckhefer et al. | 428/92 |
| 6,177,170 | B1 * | 1/2001 | Nash et al. | 428/91 |
| 7,186,451 | B2 * | 3/2007 | Zafiroglu et al. | 428/102 |
| 8,028,386 | B2 * | 10/2011 | Rock et al. | 28/160 |
| 2006/0093781 | A1 | 5/2006 | Kuroda et al. | |
| 2007/0101771 | A1 * | 5/2007 | Wildeman et al. | 66/169 R |
| 2008/0199651 | A1 | 8/2008 | Matsumoto | |
| 2011/0296875 | A1 * | 12/2011 | Tokumoto et al. | 66/194 |

FOREIGN PATENT DOCUMENTS

| | | | |
|---|---|---|---|
| JP | 61-013020 | B2 | 4/1986 |
| JP | 6-173143 | A | 6/1994 |
| JP | 7-305249 | A | 11/1995 |
| JP | 3026628 | U | 7/1996 |
| JP | 8-260289 | A | 10/1996 |
| JP | 9-302554 | A | 11/1997 |
| JP | 10-137103 | A | 5/1998 |
| JP | 2005-220454 | A | 8/2005 |
| JP | 2006-111985 | A | 4/2006 |
| RU | 907098 | A1 | 2/1982 |
| RU | 2177516 | C2 | 12/2001 |
| SU | 1428768 | A1 | 10/1988 |
| SU | 1772241 | A1 | 10/1992 |
| WO | 2004/009891 | A1 | 1/2004 |
| WO | 2005/108662 | A1 | 11/2005 |

OTHER PUBLICATIONS

Notice of Allowance dated Jan. 30, 2012, issued in Ukraine Patent Application No. 201110570.

Chinese Office Action dated Feb. 24, 2011, issued in corresponding Chinese patent application No. 200980100571.X.

International Search Report of PCT/JP2009/052800, mailing date May 19, 2009.

* cited by examiner

PILE KNITTED FABRIC AND SEWN PRODUCT EMPLOYING PILE KNITTED FABRIC

TECHNICAL FIELD

The present invention relates to a pile knitted fabric. The present invention further relates to a pile knitted fabric that looks unpatterned in a flat state but whose pattern appears when unflattened in a sewn or worn state.

BACKGROUND ART

Conventionally, pile knitted fabrics have been known as fake furs. Especially, in recent years, due to the decrease in the number of wild animals such as foxes, sables, minks and chinchillas as well as from the aspect of the animal protection, fake furs are reviewed centering on Europe and the United States. Generally, animal hairs that are furs of wild animals are composed of two layers, i.e., guard hairs and downy hairs, and a high pile fabric that imitates this configuration has been proposed (Patent Document 1). Further, since napped fibers in a pile knitted fabric fall off easily, a knitted fabric having a structure of 1-stitch skip or 3-stitch skip has been proposed for allowing a backing resin to be impregnated smoothly (Patent Document 2).

However, in a general sewn product of a pile fabric that employs a high pile fabric as described in Patent Document 1, even if wrinkles or crinkles are caused due to the motion such as walking or the sway of the wind during wearing, the pattern of the fabric does not change largely as compared with a static state, and therefore, the designability is low. Further, in the pile knitted fabric having the structure of 3-stitch skip described in Patent Document 2, although a loop of a ground yarn alone and a loop of a ground yarn knitted with a sliver coexist in a wale direction of a knitted structure and this reduces the density of pile fibers, a stitch pattern does not appear. In this case, the stitch pattern is made not to appear, because if the stitch pattern appears, the fabric looks nonuniform and the appearance becomes worse, which reduces the value as a product. As described above, the napped pile knitted fabrics proposed in Patent Documents 1 and 2 have a problem that they are unpatterned as a stitch pattern in the flat state as viewed from a pile fiber side and in a sewn or worn state, and do not change largely.

[Patent Document 1] JP 2006-111985 A

[Patent Document 2] JP 06 (1994) 173143 A

SUMMARY OF THE INVENTION

In order to solve the above-described conventional problem, the present invention provides a pile knitted fabric that looks unpatterned in a flat state as viewed from a pile fiber side but whose pattern appears when unflattened in a sewn or worn state.

A pile knitted fabric of the present invention is a pile knitted fabric containing a ground structure and a pile fiber napped from the ground structure, the pile knitted fabric including the pile fiber that is knitted into a stitch of the ground structure and napped therefrom; and a stitch composed only of the ground structure, wherein a pile length of the pile knitted fabric is 6 to 25 mm, a continuous length of a pile fiber portion where the pile fiber is knitted into the stitch of the ground structure and napped therefrom is 10 mm or more, a width of a line of a stitch pattern composed only of the ground structure is 1 to 6 mm, a continuous length of the line of the stitch pattern composed only of the ground structure is 10 mm or more, a ratio of the width of the line of the stitch pattern composed only of the ground structure to the pile length is 0.09 to 0.30, and when a weft direction of the pile knitted fabric is placed horizontally, an acute angle formed between the weft direction of the pile knitted fabric and the line of the stitch pattern composed only of the ground structure is 20° to 90°.

A sewn product of the present invention employs the above-described pile knitted fabric of the present invention.

DESCRIPTION OF THE INVENTION

Figure 1A:
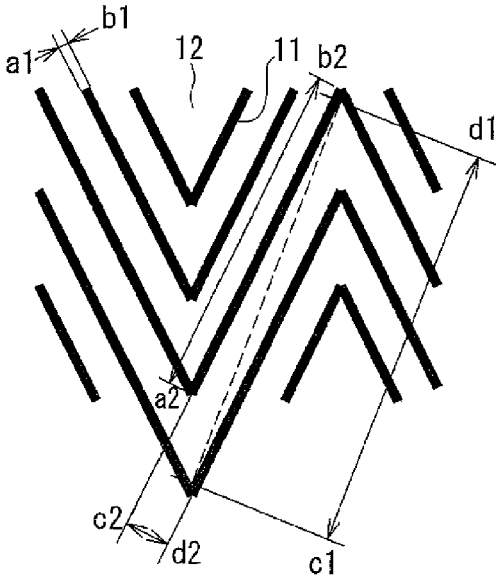
FIG. 1A is a schematic diagram of a herringbone pattern as an example of a stitch pattern.
Figure 1D:
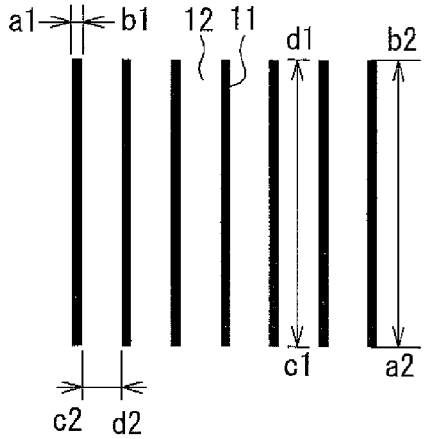
FIG. 1D is a schematic diagram of a stripe pattern as an example of the stitch pattern.
Figure 1B:
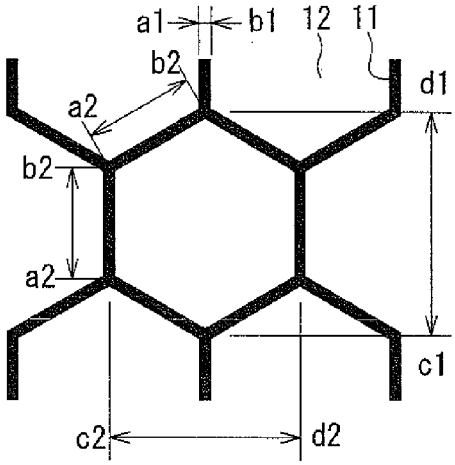
FIG. 1B is a schematic diagram of a honeycomb pattern as an example of the stitch pattern.
Figure 1C:
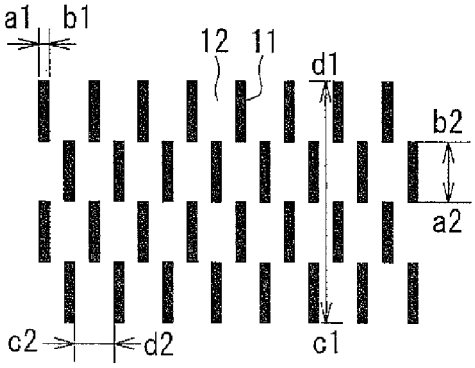
FIG. 1C is a schematic diagram of a houndtooth pattern as an example of the stitch pattern.

A pile knitted fabric of the present invention includes a pile fiber that is knitted into a stitch of the ground structure and napped therefrom; and a stitch composed only of the ground structure, wherein a pile length of the pile knitted fabric is 6 to 25 mm, a continuous length of a pile fiber portion where the pile fiber is knitted into the stitch of the ground structure and napped therefrom is 10 mm or more, a width of a line of a stitch pattern composed only of the ground structure is 1 to 6 mm, a continuous length of the line of the stitch pattern composed only of the ground structure is 10 mm or more, a ratio of the width of the line of the stitch pattern composed only of the ground structure to the pile length is 0.09 to 0.30, and when a weft direction of the pile knitted fabric is placed horizontally, an acute angle formed between the weft direction of the pile knitted fabric and the line of the stitch pattern composed only of the ground structure is 20° to 90°.

The above-described stitch pattern composed only of the ground structure (hereinafter, also referred to as a stitch pattern simply) cannot be seen or noticed in the flat state as viewed from a pile fiber side but appears in the non-flat state. In other words, the pile knitted fabric looks unpatterned in the flat state but whose stitch pattern appears when unflattened in a sewn or worn state. This pattern is a hidden pattern formed by the stitch pattern.

The stitch pattern is not limited particularly, and examples thereof include a stripe pattern, a border pattern, an oblique stripe pattern, a check pattern, a zigzag pattern, a concave-convex pattern, a wave pattern, a spiral pattern, a herringbone pattern, a honeycomb pattern, a houndtooth pattern, and appropriately combined patterns of these. The above-described stitch pattern can be considered as a pattern formed by lines. For example, FIGS. 1A to 1D are schematic diagrams showing the herringbone, honeycomb, houndtooth and stripe patterns formed by lines, respectively. Here, the lines are not limited particularly, and include various lines such as a straight line, a wavy line, a zigzag line and a curve line.

The width of the line of the stitch pattern is 1 to 6 mm, and preferably 1.3 to 6 mm. When the width of the line of the stitch pattern is 1 to 6 mm, the stitch pattern is more likely to be hidden in the flat state and more likely to appear in the non-flat state by bending, etc. Here, the widths of the line of the stitch pattern are, for example, widths indicated by a1-b1 in FIGS. 1A to 1D.

The continuous length of the line of the stitch pattern is 10 mm or more, and preferably 15 mm or more. When the continuous length of the line of the stitch pattern is 10 mm or more, the stitch pattern is more likely to be hidden in the flat state and more likely to appear in the non-flat state by bending, etc. Here, the continuous lengths of the line of the stitch pattern are, for example, lengths indicated by a2-b2 in FIGS. 1A to 1D. Note here that, as to the honeycomb pattern shown in FIG. 1B, the line of the stitch pattern has continuous lengths in two directions (warp and oblique directions).

The ratio of the width of the line of the stitch pattern to the pile length is 0.09 to 0.30, and preferably 0.10 to 0.25. Here, the ratio of the width of the line of the stitch pattern to the pile length refers to a ratio indicated by "the width of the line of the stitch pattern/the pile length". When the ratio of the width of the line of the stitch pattern to the pile length is 0.09 to 0.30, the stitch pattern is more likely to be hidden in the flat state and more likely to appear in the non-flat state by bending, etc.

When a weft direction of the pile knitted fabric is placed horizontally, an acute angle formed between the weft direction of the pile knitted fabric and the line of the stitch pattern composed only of the ground structure is 20° to 90°, and preferably 40° to 80°. In this range, the stitch pattern is more likely to be hidden in the flat state and more likely to appear in the non-flat state by bending, etc.

The stitches composed only of the ground structure are preferably 15 to 55% based on the total stitches, and more preferably 20 to 45%. In this range, the stitch pattern is more likely to be hidden in the flat state and more likely to appear in the non-flat state by bending, etc.

The continuous length of the pile fiber portion where pile fibers are knitted into the stitches of the ground structure and napped therefrom (hereinafter, referred to as a pile fiber portion simply) is 10 mm or more, and preferably 15 mm or more. In this range, the stitch pattern is more likely to be hidden in the flat state and more likely to appear in the non-flat state by bending, etc. Here, the continuous length of the pile fiber portion refers to a length that is longest among lengths of the pile fiber portions sandwiched by the stitches composed only of the ground structure. For example, in the schematic diagrams of the stitch patterns shown in FIGS. 1A to 1D, the continuous length of the pile fiber portion is a length between c1 and d1.

The width of the pile fiber portion is preferably 1.5 mm or more, and more preferably 1.5 to 30 mm. In the range of 1.5 mm or more, the stitch pattern is more likely to be hidden in the flat state and more likely to appear in the non-flat state by bending, etc. Here, the width of the pile fiber portion refers to a length that is shortest among lengths of the pile fiber portions sandwiched by the stitches composed only of the ground structure. For example, in the schematic diagrams of the stitch patterns shown in FIGS. 1A to 1D, the width of the pile fiber portion is a length between c2 and d2.

The pile length of the pile knitted fabric is 6 to 25 mm, and preferably 10 to 22 mm. In this range, the stitch pattern is more likely to be hidden in the flat state and more likely to appear in the non-flat state by bending, etc. In the present invention, the pile length refers to a length from a root (root of a surface of the pile knitted fabric) to a tip of pile fibers in the state where the pile fibers of the pile knitted fabric are napped vertically so that the piles are aligned.

The sewn product is not limited as long as the pile knitted fabric of the present invention is used therein, and examples thereof include a coat, a jacket, a vest, a dress and a shirt. When the weft direction of the sewn product is placed horizontally, an acute angle formed between the weft direction of the sewn product and the line of the stitch pattern composed only of the ground structure is 20° to 90°, and preferably 40° to 80°. In this range, during the wearing of the sewn product, the pattern appears in a body portion or a sleeve portion by the motion of a body or the sway of the wind, etc., or the swing of arms while walking.

Hereinafter, a method for producing the pile knitted fabric of the present invention will be described based on drawings, etc.

Figure 2:
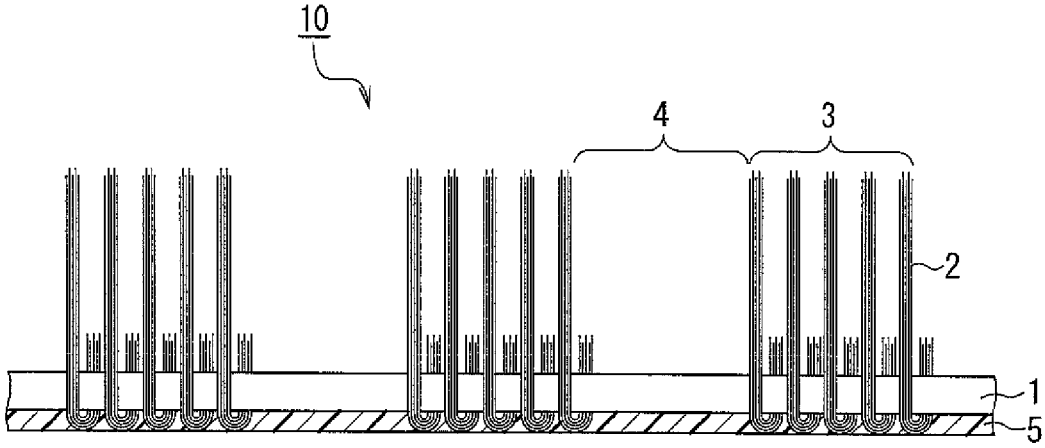
FIG. 2 is a schematic cross-sectional view of a pile knitted fabric in one Example of the present invention.
Figure 3A:
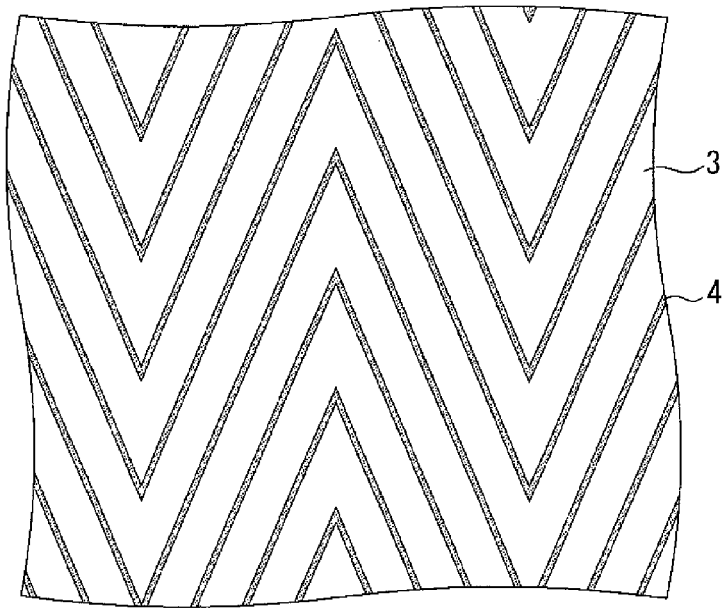
FIG. 3A shows a pattern in which stitches 4 composed only of the ground structure form an acute herringbone (zigzag) pattern between napped portions 3.
Figure 3B:
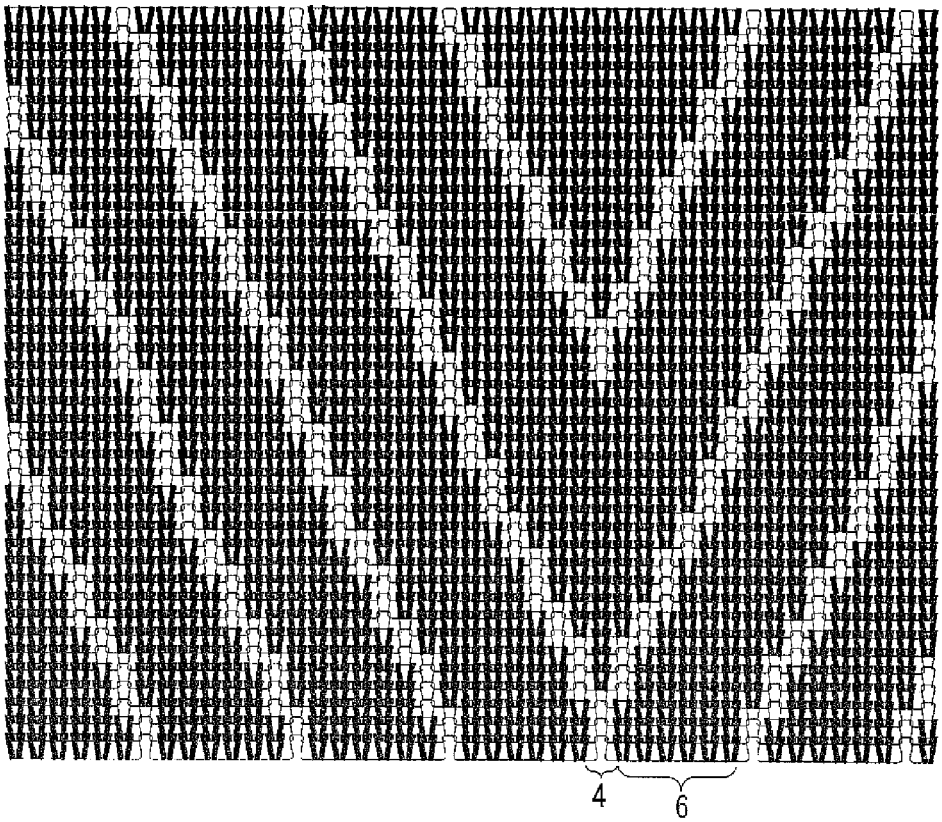
FIG. 3B is a knitting structure diagram of the pattern.
Figure 4A:
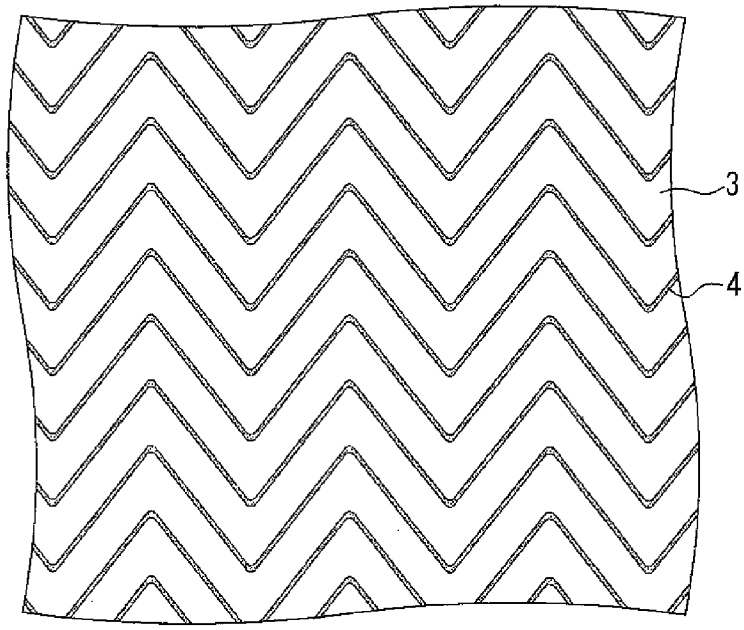
FIG. 4A shows a pattern in which the stitches 4 form a herringbone (zigzag) pattern with an angle more obtuse than the angle in FIG. 3A.
Figure 4B:
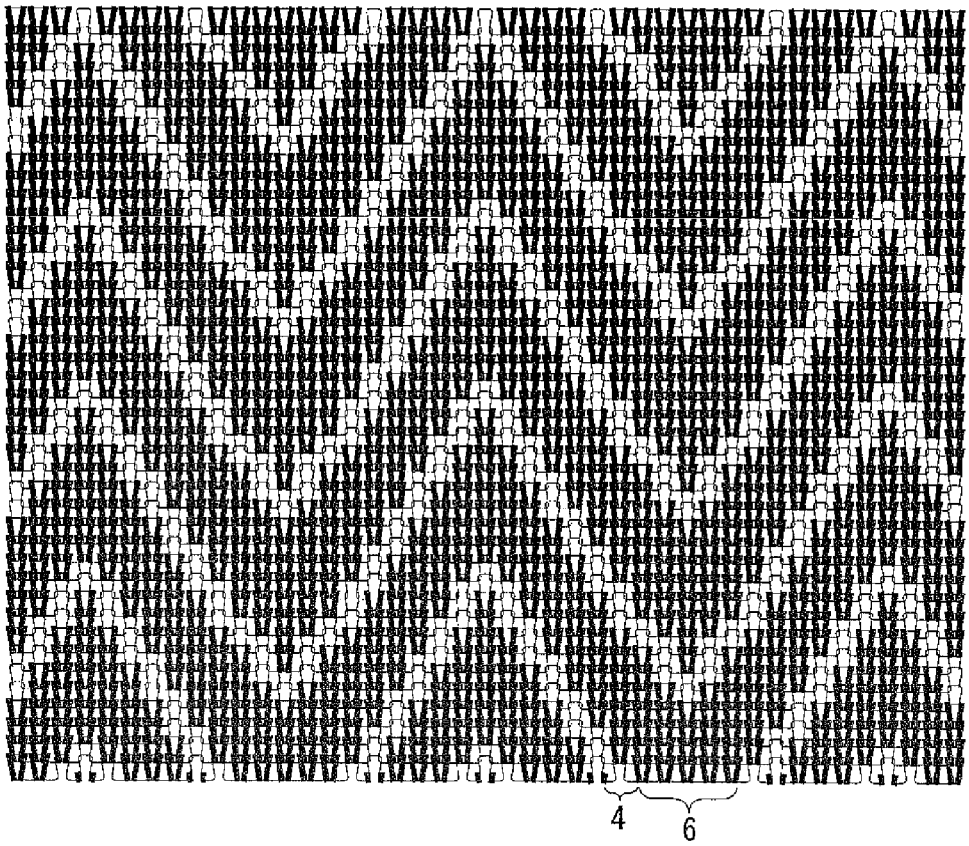
FIG. 4B is a knitting structure diagram of the pattern.
Figure 5A:
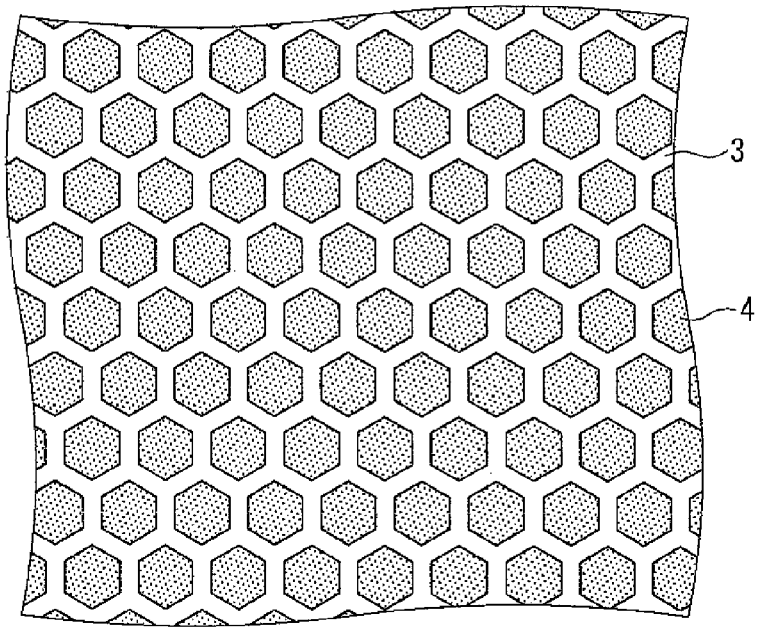
FIG. 5A shows a honeycomb pattern.
Figure 5B:
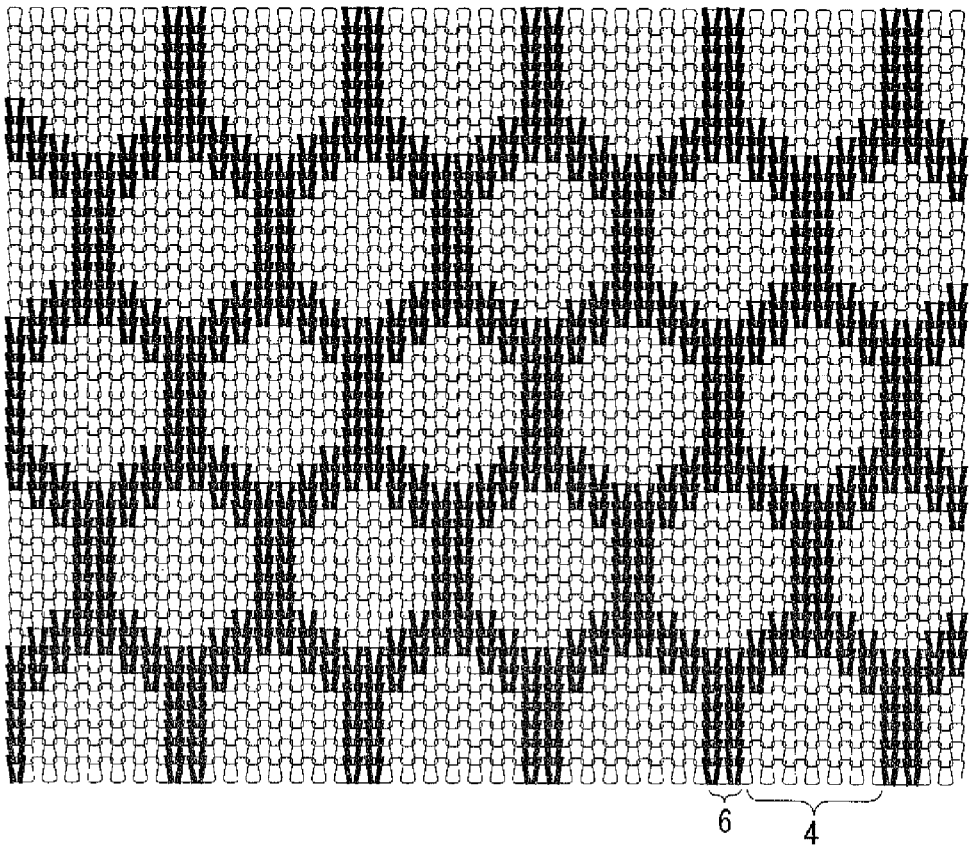
FIG. 5B is a knitting structure diagram of the pattern.
Figure 6A:
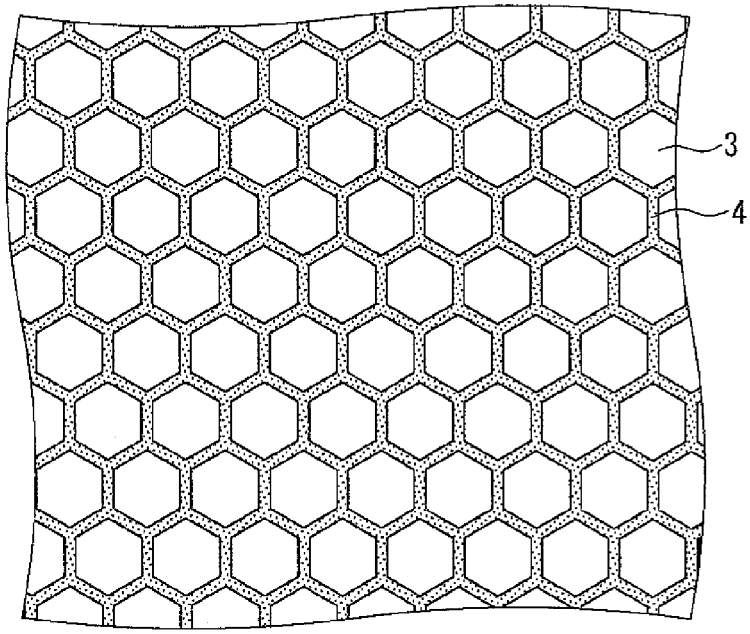
FIG. 6A shows an inverted pattern of FIG. 4A.
Figure 6B:
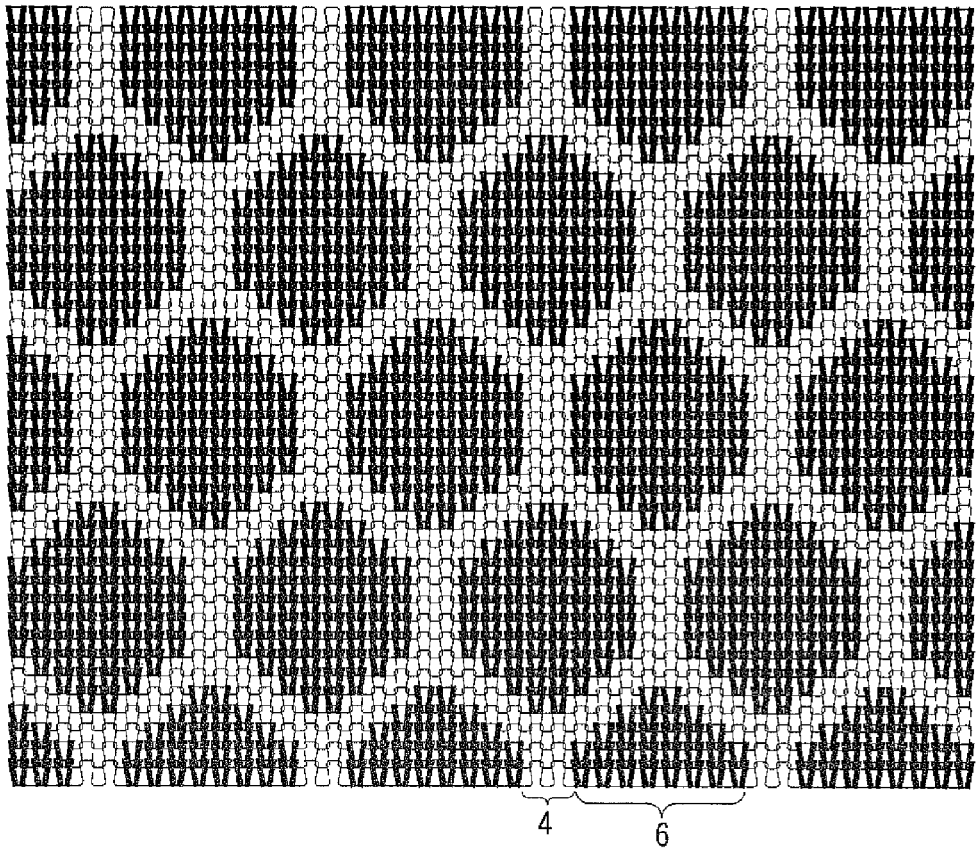
FIG. 6B is a knitting structure diagram of the pattern.
Figure 7A:
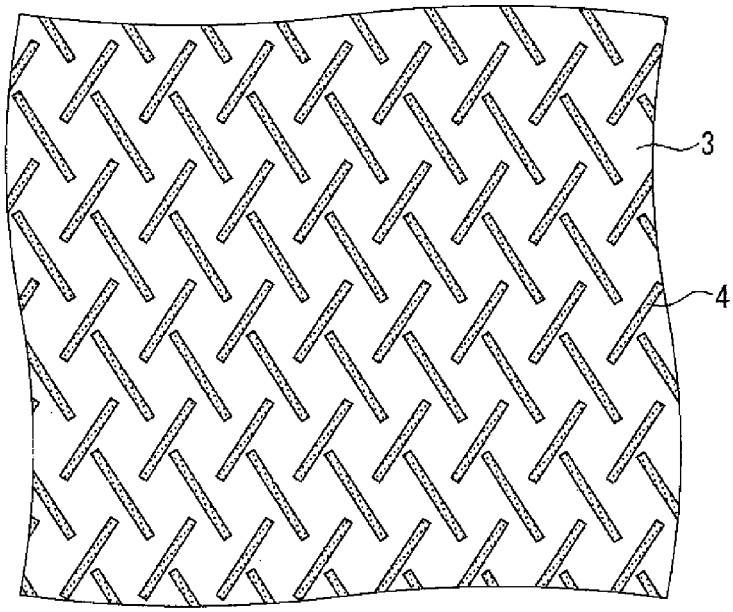
FIG. 7A shows a dashed, oblique check pattern.
Figure 7B:
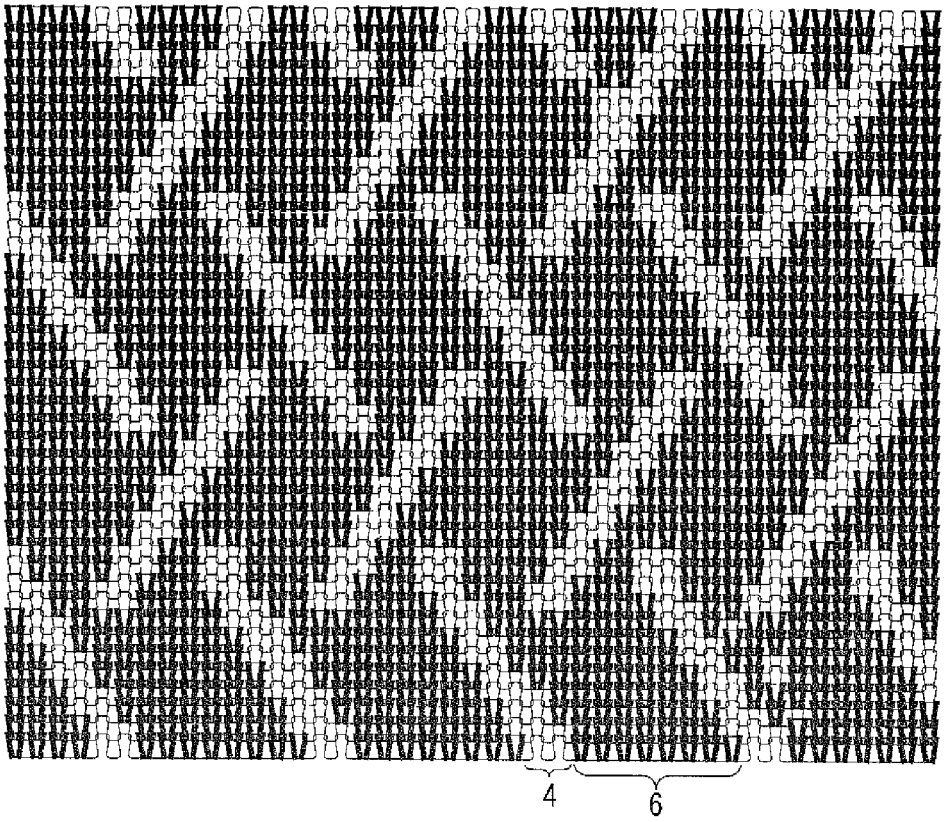
FIG. 7B is a knitting structure diagram of the pattern.

FIG. 2 is a schematic cross-sectional view of a pile knitted fabric in one Example of the present invention. A pile knitted fabric 10 includes a ground structure 1, pile fibers 2, napped portions 3 where the pile fibers 2 are gathered, and stitches 4 composed only of the ground structure. A backing agent 5 is applied on a back face of the ground structure. In the flat state of the pile knitted fabric 10 as viewed from the pile fiber side, since the pile fibers 2 are napped in the napped portions 3, a stitch pattern formed by the stitches 4 composed only of the ground structure cannot be seen or noticed by being hidden. However, when the pile knitted fabric 10 is in the non-flat state by bending, etc., the stitch pattern appears.

FIGS. 3 to 7 are plan views (actual size) exemplarily showing the stitch patterns composed only of the ground structure. FIG. 3A shows a pattern in which the stitches 4 composed only of the ground structure form an acute herringbone (zigzag) pattern between the napped portions 3, and FIG. 3B is a knitting structure diagram of the pattern. FIG. 4A shows a pattern in which the stitches 4 form a herringbone (zigzag) pattern with an angle more obtuse than the angle in FIG. 3A, and FIG. 4B is a knitting structure diagram of the pattern. FIG. 5A shows a honeycomb pattern, and FIG. 5B is a knitting structure diagram of the pattern. FIG. 6A shows an inverted pattern of FIG. 5A, and FIG. 6B is a knitting structure diagram of the pattern. FIG. 7A shows a dashed, oblique check pattern, and FIG. 7B is a knitting structure diagram of the pattern.

The pile knitted fabric may be any knitted fabric, such as a warp knit, a weft knit or a circular knit. Among these, a sliver knit is preferable in which fiber yarns are used as the ground structure and slivers (thrum) are used as the pile fibers.

The fiber yarn used as the ground structure is not limited particularly as long as it is usable in the pile knitted fabric. Examples thereof include spun fibers made of polyester, acrylic, vinyl chloride, polypropylene and polyethylene, filament fibers, or spun fibers such as cotton. These fibers can be used alone or in combination of two or more kinds.

The fiber used as the sliver is not limited particularly as long as it is usable in the pile knitted fabric. Examples thereof include synthetic fibers such as nylon, polyester, acrylic, modacrylic, vinyl chloride series, polypropylene and polyethylene, artificial fibers such as rayon and acetate, and natural fibers such as cotton and wool. These fibers can be used alone or in combination of two or more kinds.

A type, a fineness, a length or the like of the fiber used as the sliver can be selected arbitrarily in accordance with the properties of the product. Ahue of the fiber also can be adjusted by mixing a dyed fiber and a spun-dyed fiber depending on the intended use.

In the sliver knit, while the stitches of the ground structure are knitted using fiber yarns, sliver fibers are knitted into the stitches of the ground structure and passed around the stitches in a U-shape to form pile fibers. At this time, in the present invention, the stitches 4 composed only of the ground structure are knitted as shown in FIG. 2 without feeding slivers to specified knitting pins. Thus, specific stitch patterns such as the stitch patterns shown in FIGS. 3 and 7 formed. This can be controlled by, for example, applying a pattern knitting mechanism, such as a pattern wheel, a drum and a computer system. Note here that a backing agent is coated on the back face of the knitted fabric to fix the pile fibers. The backing agent is not limited particularly as long as it is usable in the pile knitted fabric, and examples thereof include polyacrylic ester, polyvinyl acetate, acrylic ester and vinyl acetate copolymer. Moreover, dyeing, shearing (aligning the length of piles), polishing (thermal treatment of piles) and the like may be performed on the pile fibers.

In the above-described manner, it is possible to obtain the pile knitted fabric of the present invention. The pile knitted fabric of the present invention has an effect that it looks unpatterned in the flat state as viewed from the pile fiber side but the stitch pattern composed only of the ground structure appears in the non-flat state by bending, etc., thereby providing excellent designability. Further, the pile knitted fabric of the present invention has an effect that when the fabric is employed in a sewn product, the stitch pattern does not appear in a static state but appears by the motion such as walking, thereby providing excellent designability.

Further, since a part of the pile knitted fabric of the present invention is not fed with pile fibers, the density (weight per unit area) thereof is reduced, whereby a comfortable knitted fabric is obtained. In general, outdoor clothes such as overcoats and coats made of natural furs or fake furs are heavy and this becomes a cause of shoulder stiffness, etc. However, since a part of the pile knitted fabric of the present invention is not fed with pile fibers, the total weight is light, and a comfortable knitted fabric is obtained. It is preferable that the density of the pile knitted fabric of the present invention is 300 to 550 g/m$^{2.}$

EXAMPLES

Hereinafter, the present invention will be described more specifically by way of Examples. Note here that the present invention is not limited to the following Examples.

First, a measurement method used in Examples will be described.

(Pile Length)

After pile fibers of a pile knitted fabric were napped vertically so that the piles were aligned, a length from a root (root of a surface of the pile knitted fabric) to a tip of the pile fibers was measured using a vernier caliper.

(Widths and Continuous Lengths of the Line of the Stitch Pattern and the Pile Fiber Portion)

As shown in FIGS. 1A to 1D, the width and the continuous length of the line of the stitch pattern as well as the continuous length and the width of the pile fiber portion in the pile knitted fabric were measured using a vernier caliper.

Example 1

Figure 8A:
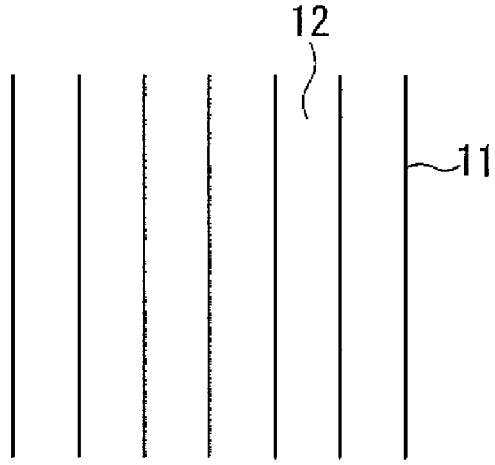
FIG. 8A is a schematic diagram of the stitch pattern in pile knitted fabrics of Examples 1, 2 and Comparative Example 1.

First, a sliver was produced using a fiber of KANEKALON AH (fineness: 3.3 dtex, fiber length: 38 mm). Next, the above-described sliver and a ground yarn (fineness: 165 dtex) composed of polyester fibers were used to obtain, by a high-pile knitter, a pile knitted fabric whose stitch pattern composed only of the ground structure was a stripe pattern. The width of the line of the stitch pattern was 1.3 mm, and the continuous length thereof was 400 mm. When the weft direction of the pile knitted fabric was placed horizontally, an acute angle formed between the weft direction of the pile knitted fabric and the line of the stitch pattern composed only of the ground structure (hereinafter, referred to as an angle of the line of the stitch pattern simply) was 90°. The continuous length of the pile fiber portion was 400 mm, and the width thereof was 11.7 mm. Then, after an acrylic ester adhesive was applied on the back face of the pile knitted fabric and dried at 125° C., electropolishing, brushing and shearing were performed, whereby a pile knitted fabric of Example 1 having a pile length of 6 mm and a final density of 340 g/m$^2$ was obtained. FIG. 8A shows a schematic diagram of the stitch pattern in the pile knitted fabric of Example 1.

Example 2

A pile knitted fabric of Example 2 was obtained in the same manner as in Example 1, except that the pile length was 8 mm and the final density was 390 g/m$^2$. FIG. 8A shows a schematic diagram of the stitch pattern in the pile knitted fabric of Example 2.

Example 3

Figure 8B:
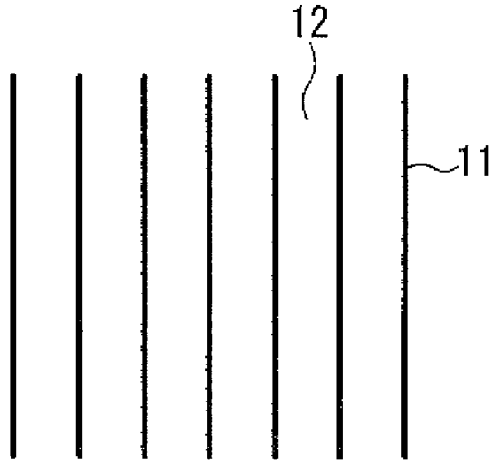
FIG. 8B is a schematic diagram of the stitch pattern in a pile knitted fabric of Example 3.

A pile knitted fabric of Example 3 was obtained in the same manner as in Example 1, except that the width of the line of the stitch pattern was 2.2 mm, the pile length was 8 mm and the final density was 340 g/m$^2$. FIG. 8B shows a schematic diagram of the stitch pattern in the pile knitted fabric of Example 3.

Example 4

Figure 9A:
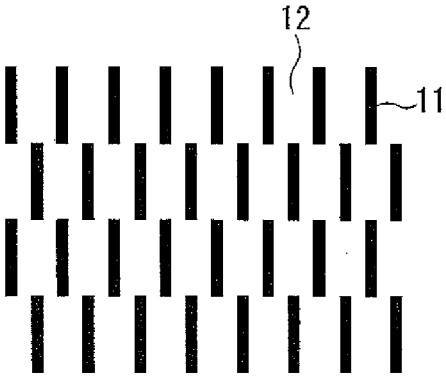
FIG. 9A is a schematic diagram of the stitch pattern in a pile knitted fabric of Example 4.

First, a sliver was produced using a fiber of KANEKALON AH (fineness: 3.3 dtex, fiber length: 38 mm). Next, the above-described sliver and a ground yarn (fineness: 165 dtex) composed of polyester fibers were used to obtain, by a high-pile knitter, a pile knitted fabric whose stitch pattern composed only of the ground structure was a houndtooth pattern. The width of the line of the stitch pattern was 1.3 mm, the continuous length thereof was 10 mm, and the angle thereof was 90°. The continuous length of the pile fiber portion was 400 mm, and the width thereof was 4.5 mm. Then, after an acrylic ester adhesive was applied on the back face of the pile knitted fabric and dried at 125° C., electropolishing, brushing and shearing were performed, whereby a pile knitted fabric of Example 4 having a pile length of 8 mm and a final density of 370 g/m$^2$ was obtained. FIG. 9A shows a schematic diagram of the stitch pattern in the pile knitted fabric of Example 4.

Example 5

Figure 10A:
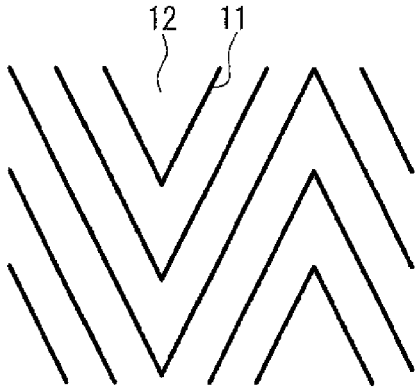
FIG. 10A is a schematic diagram of the stitch pattern in a pile knitted fabric of Example 5.

First, a sliver was produced using a fiber of KANEKALON AH (fineness: 3.3 dtex, fiber length: 38 mm). Next, the above-described sliver and a ground yarn (fineness: 165 dtex) composed of polyester fibers were used to obtain, by a high-pile knitter, a pile knitted fabric whose stitch pattern composed only of the ground structure was a herringbone pattern. The width of the line of the stitch pattern was 2.2 mm, the continuous length thereof was 100 mm, and the angle thereof was 70°. The continuous length of the pile fiber portion was 105 mm, and the width thereof was 7.8 mm. Then, after an acrylic ester adhesive was applied on the back face of the pile knitted fabric and dried at 125° C., electropolishing, brushing and shearing were performed, whereby a pile knitted fabric of Example 5 having a pile length of 18 mm and a final density of 410 g/m$^2$ was obtained. FIG. 10A shows a schematic diagram of the stitch pattern in the pile knitted fabric of Example 5.

Example 6

Figure 10D:
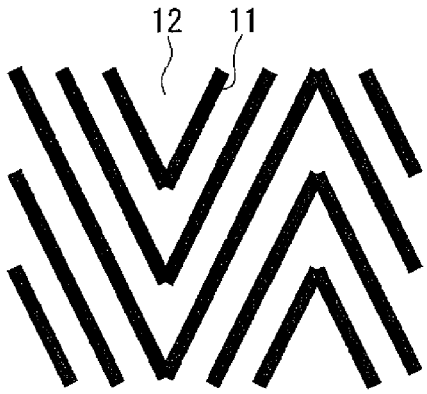
FIG. 10D is a schematic diagram of the stitch pattern in a pile knitted fabric of Comparative Example 5.
Figure 10B:
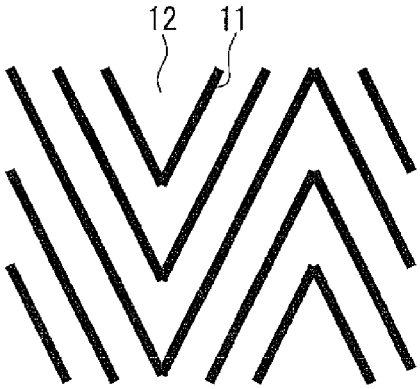
FIG. 10B is a schematic diagram of the stitch pattern in a pile knitted fabric of Example 6.

A pile knitted fabric of Example 6 was obtained in the same manner as in Example 5, except that the width of the line of the stitch pattern was 4.0 mm and the final density was 340 g/m$^2$. FIG. 10B shows a schematic diagram of the stitch pattern in the pile knitted fabric of Example 6.

Example 7

Figure 10E:
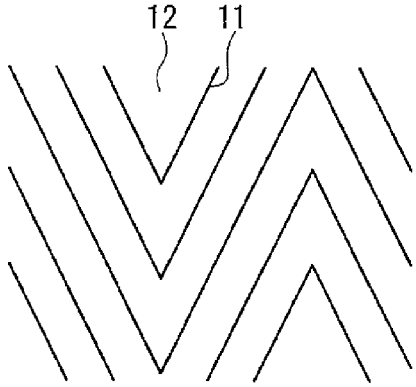
FIG. 10E is a schematic diagram of the stitch pattern in a pile knitted fabric of Comparative Example 4.
Figure 10C:
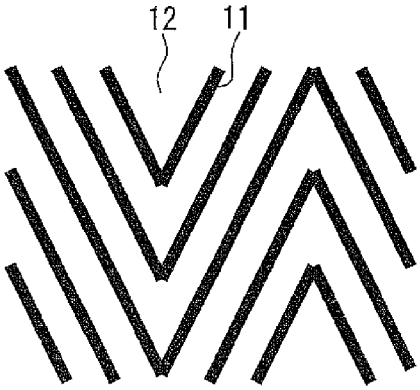
FIG. 10C is a schematic diagram of the stitch pattern in a pile knitted fabric of Example 7.

A pile knitted fabric of Example 7 was obtained in the same manner as in Example 5, except that the width of the line of the stitch pattern was 5.2 mm and the final density was 320 g/m$^2$. FIG. 10C shows a schematic diagram of the stitch pattern in the pile knitted fabric of Example 7.

Example 8

Figure 11A:
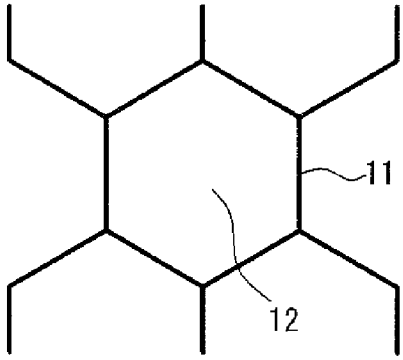
FIG. 11A is a schematic diagram of the stitch pattern in a pile knitted fabric of Example 8.

First, a sliver was produced using a fiber of KANEKALON A11 (fineness: 3.3 dtex, fiber length: 38 mm). Next, the above-described sliver and a ground yarn (fineness: 165 dtex) composed of polyester fibers were used to obtain, by a high-pile knitter, a pile knitted fabric whose stitch pattern composed only of the ground structure was a honeycomb pattern. The width of the line of the stitch pattern was 2.3 mm, the continuous length thereof in the oblique direction was 19 mm, the continuous length thereof in the warp direction was 10 mm, and the angles thereof were 40° and 90°. The continuous length of the pile fiber portion was 27 mm, and the width thereof was 22 mm. Then, after an acrylic ester adhesive was applied on the back face of the pile knitted fabric and dried at 125° C., electropolishing, brushing and shearing were performed, whereby a pile knitted fabric of Example 8 having a pile length of 25 mm and a final density of 520 g/m$^2$ was obtained. FIG. 11A shows a schematic diagram of the stitch pattern in the pile knitted fabric of Example 8.

Example 9

Figure 11D:
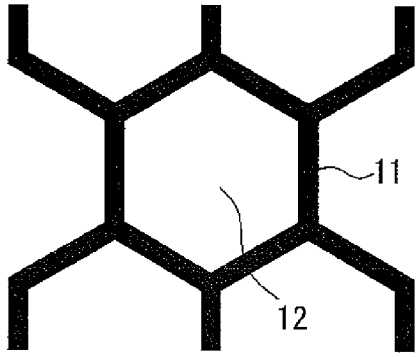
FIG. 11D is a schematic diagram of the stitch pattern in pile knitted fabrics of Example 11 and Comparative Example 7.
Figure 11B:
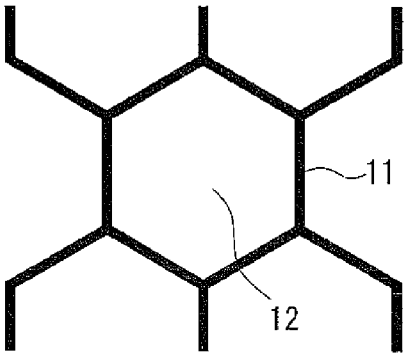
FIG. 11B is a schematic diagram of the stitch pattern in a pile knitted fabric of Example 9.

A pile knitted fabric of Example 9 was obtained in the same manner as in Example 8, except that the width of the line of the stitch pattern was 3.3 mm and the final density was 450 g/m$^2$. FIG. 11B shows a schematic diagram of the stitch pattern in the pile knitted fabric of Example 9.

Example 10

Figure 11E:
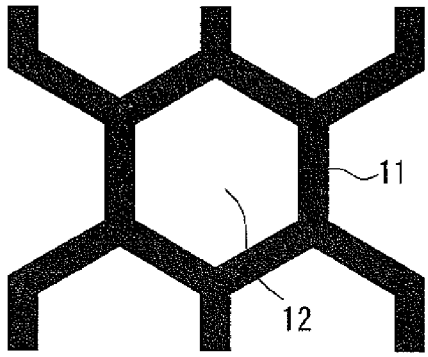
FIG. 11E is a schematic diagram of the stitch pattern in a pile knitted fabric of Comparative Example 6.
Figure 11C:
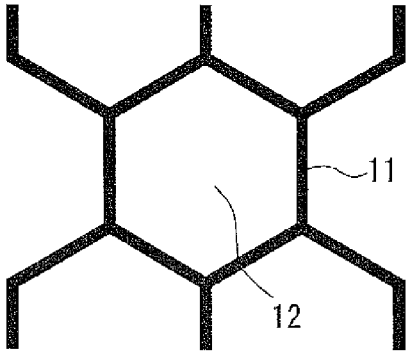
FIG. 11C is a schematic diagram of the stitch pattern in a pile knitted fabric of Example 10.

A pile knitted fabric of Example 10 was obtained in the same manner as in Example 8, except that the width of the line of the stitch pattern was 4.7 mm and the final density was 430 g/m$^2$. FIG. 11C shows a schematic diagram of the stitch pattern in the pile knitted fabric of Example 10.

Example 11

A pile knitted fabric of Example 11 was obtained in the same manner as in Example 8, except that the width of the line of the stitch pattern was 6.0 mm and the final density was 410 g/m$^2$. FIG. 11D shows a schematic diagram of the stitch pattern in the pile knitted fabric of Example 11.

Example 12

Figure 9B:
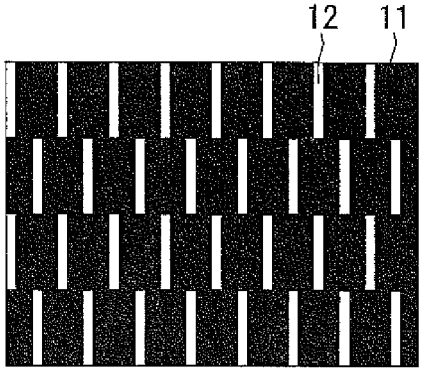
FIG. 9B is a schematic diagram of the stitch pattern in a pile knitted fabric of Example 12.

First, a sliver was produced using a fiber of KANEKALON AH (fineness: 3.3 dtex, fiber length: 38 mm). Next, the above-described sliver and a ground yarn (fineness: 165 dtex) composed of polyester fibers were used to obtain, by a high-pile knitter, a pile knitted fabric whose stitch pattern composed only of the ground structure was a houndtooth pattern. The width of the line of the stitch pattern was 1.3 mm, the continuous length thereof was 400 mm, and the angle thereof was 90°. The continuous length of the pile fiber portion was 10 mm, and the width thereof was 1.5 mm. Then, after an acrylic ester adhesive was applied on the back face of the pile knitted fabric and dried at 125° C., electropolishing, brushing and shearing were performed, whereby a pile knitted fabric of Example 12 having a pile length of 8 mm and a final density of 300 g/m$^2$ was obtained. FIG. 9B shows a schematic diagram of the stitch pattern in the pile knitted fabric of Example 12.

Example 13

Figure 12A:
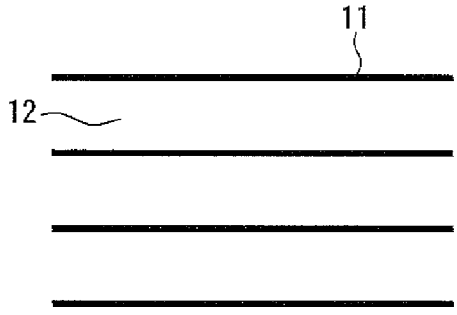
FIG. 12A is a schematic diagram of the stitch pattern in a pile knitted fabric of Comparative Example 10.
Figure 12D:
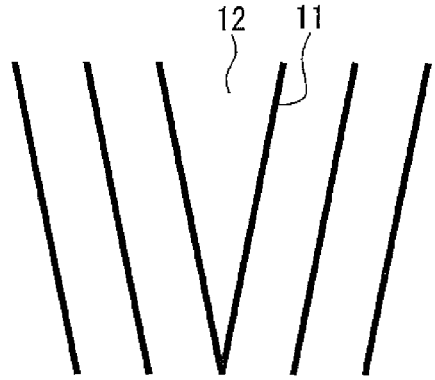
FIG. 12D is a schematic diagram of the stitch pattern in a pile knitted fabric of Example 14.
Figure 12B:
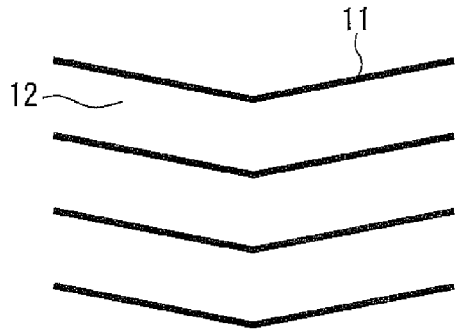
FIG. 12B is a schematic diagram of the stitch pattern in a pile knitted fabric of Comparative Example 11.
Figure 12C:
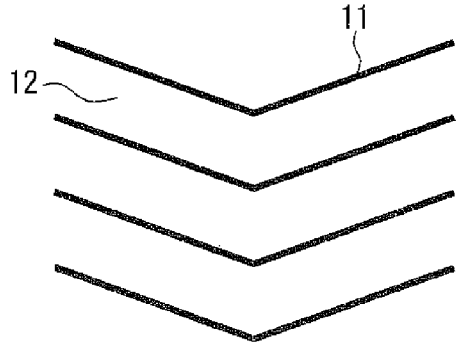
FIG. 12C is a schematic diagram of the stitch pattern in a pile knitted fabric of Example 13.

First, a sliver was produced using a fiber of KANEKALON AH (fineness: 3.3 dtex, fiber length: 38 mm). Next, the above-described sliver and a ground yarn (fineness: 165 dtex) composed of polyester fibers were used to obtain, by a high-pile knitter, a pile knitted fabric whose stitch pattern composed only of the ground structure was a herringbone pattern. The width of the line of the stitch pattern was 6.0 mm, the continuous length thereof was 50 mm, and the angle thereof was 20°. The continuous length of the pile fiber portion was 50 mm, and the width thereof was 30 mm. Then, after an acrylic ester adhesive was applied on the back face of the pile knitted fabric and dried at 125° C., electropolishing, brushing and shearing were performed, whereby a pile knitted fabric of Example 13 having a pile length of 25 mm and a final density of 410 g/m$^2$ was obtained. FIG. 12C shows a schematic diagram of the stitch pattern in the pile knitted fabric of Example 13.

Example 14

A pile knitted fabric of Example 14 was obtained in the same manner as in Example 13, except that the angle of the line of the stitch pattern was 80° and the final density was 400 g/m$^2$. FIG. 12D shows a schematic diagram of the stitch pattern in the pile knitted fabric of Example 14.

Comparative Example 1

A pile knitted fabric of Comparative Example 1 was obtained in the same manner as in Example 1, except that the pile length was 5 mm and the final density was 310 g/m$^2$. FIG. 8A shows a schematic diagram of the stitch pattern in the pile knitted fabric of Comparative Example 1.

Comparative Example 2

Figure 8C:
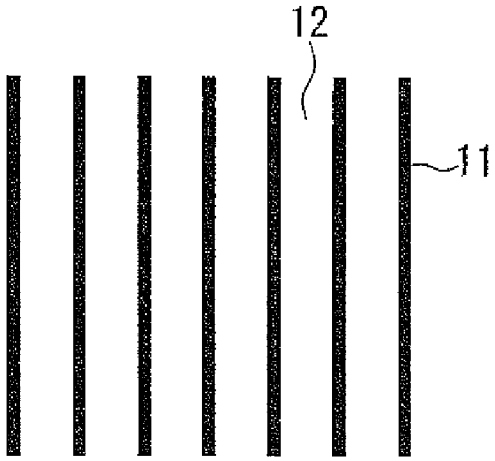
FIG. 8C is a schematic diagram of the stitch pattern in a pile knitted fabric of Comparative Example 2.

A pile knitted fabric of Comparative Example 2 was obtained in the same manner as in Example 1, except that the width of the line of the stitch pattern was 4.0 mm, the pile length was 8 mm and the final density was 300 g/m$^2$. FIG. 8C shows a schematic diagram of the stitch pattern in the pile knitted fabric of Comparative Example 2.

Comparative Example 3

Figure 9C:
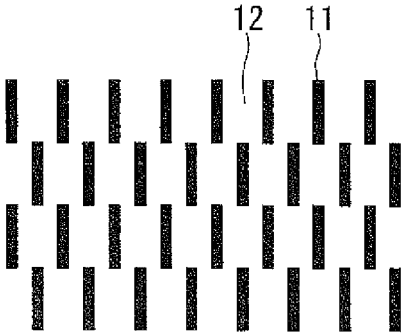
FIG. 9C is a schematic diagram of the stitch pattern in a pile knitted fabric of Comparative Example 3.

A pile knitted fabric of Comparative Example 3 was obtained in the same manner as in Example 4, except that the continuous length of the line of the stitch pattern was 7 mm and the final density was 370 g/m$^2$. FIG. 9C shows a schematic diagram of the stitch pattern in the pile knitted fabric of Comparative Example 3.

Comparative Example 4

A pile knitted fabric of Comparative Example 4 was obtained in the same manner as in Example 5, except that the width of the line of the stitch pattern was 1.3 mm and the final density was 440 g/m$^2$. FIG. 10E shows a schematic diagram of the stitch pattern in the pile knitted fabric of Comparative Example 4.

Comparative Example 5

A pile knitted fabric of Comparative Example 5 was obtained in the same manner as in Example 5, except that the width of the line of the stitch pattern was 6.5 mm and the final density was 300 g/m$^2$. FIG. 10D shows a schematic diagram of the stitch pattern in the pile knitted fabric of Comparative Example 5.

Comparative Example 6

A pile knitted fabric of Comparative Example 6 was obtained in the same manner as in Example 8, except that the width of the line of the stitch pattern was 7.0 mm and the final density was 390 g/m$^2$. FIG. 11E shows a schematic diagram of the stitch pattern in the pile knitted fabric of Comparative Example 6.

Comparative Example 7

A pile knitted fabric of Comparative Example 7 was obtained in the same manner as in Example 8, except that the width of the line of the stitch pattern was 6.0 mm, the pile length was 30 mm and the final density was 450 g/m$^2$. FIG. 11D shows a schematic diagram of the stitch pattern in the pile knitted fabric of Comparative Example 7.

Comparative Example 8

Figure 9D:
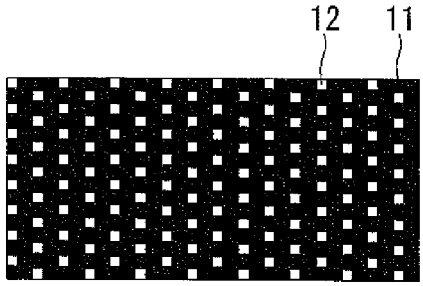
FIG. 9D is a schematic diagram of the stitch pattern in a pile knitted fabric of Comparative Example 8.

First, a sliver was produced using a fiber of KANEKALON AH (fineness: 3.3 dtex, fiber length: 38 mm). Next, the above-described sliver and a ground yarn (fineness: 165 dtex) composed of polyester fibers were used to obtain, by a high-pile knitter, a pile knitted fabric whose stitch pattern composed only of the ground structure was a houndtooth pattern (3-stitch skip). The width of the line of the stitch pattern was 1.3 mm, the continuous length thereof was 400 mm, and the angle thereof was 90°. The continuous length of the pile fiber portion was 1 mm, and the width thereof was 1.5 mm. Then, after an acrylic ester adhesive was applied on the back face of the pile knitted fabric and dried at 125° C., electropolishing, brushing and shearing were performed, whereby a pile knitted fabric of Comparative Example 8 having a pile length of 8 mm and a final density of 250 g/m$^2$ was obtained. FIG. 9D shows a schematic diagram of the stitch pattern in the pile knitted fabric of Comparative Example 8.

Comparative Example 9

Figure 9E:
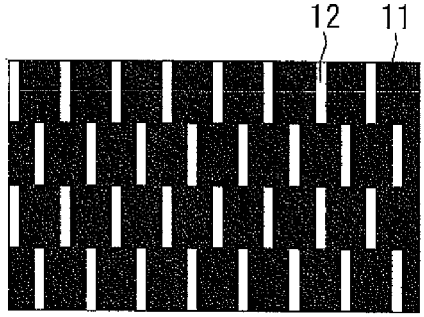
FIG. 9E is a schematic diagram of the stitch pattern in a pile knitted fabric of Comparative Example 9.

A pile knitted fabric of Comparative Example 9 was obtained in the same manner as in Comparative Example 8, except that the continuous length of the pile fiber portion was 8 mm and the final density was 290 g/m$^2$. FIG. 9E shows a schematic diagram of the stitch pattern in the pile knitted fabric of Comparative Example 9.

Comparative Example 10

First, a sliver was produced using a fiber of KANEKALON AH (fineness 3.3 dtex, fiber length: 38 mm). Next, the above-described sliver and a ground yarn (fineness: 165 dtex) composed of polyester fibers were used to obtain, by a high-pile knitter, a pile knitted fabric whose stitch pattern composed only of the ground structure was a border pattern. The width of the line of the stitch pattern was 6.0 mm, the continuous length thereof was 50 mm, and the angle thereof was 0°. The continuous length of the pile fiber portion was 50 mm, and the width thereof was 30 mm. Then, after an acrylic ester adhesive was applied on the back face of the pile knitted fabric and dried at 125° C., electropolishing, brushing and shearing were performed, whereby a pile knitted fabric of Comparative Example 10 having a pile length of 25 mm and a final density of 420 g/m$^2$ was obtained. FIG. 12A shows a schematic diagram of the stitch pattern in the pile knitted fabric of Comparative Example 10.

Comparative Example 11

A pile knitted fabric of Comparative Example 11 was obtained in the same manner as in Example 13, except that the angle of the line of the stitch pattern was 10° and the final density was 420 g/m$^2$. FIG. 12B shows a schematic diagram of the stitch pattern in the pile knitted fabric of Comparative Example 11.

The stitch patterns of the pile knitted fabrics of Examples 1-14 and Comparative Examples 1-11 in the flat state and in the nonfat state (bent state) as viewed from the pile fiber side were observed and evaluated in the following manner. The results are shown in Tables 1 and 2 below. Further, Tables 1 and 2 show the pile length; the stitch pattern; the width, continuous length and angle of the line of the stitch pattern; the width and continuous length of the pile fiber portion; and the ratio of the width of the line of the stitch pattern to the pile length, as to the pile knitted fabrics of Examples 1-14 and Comparative Examples 1-11.

(Flat State)

The stitch patterns in the flat state were observed from the pile fiber side and judged as follows.

A: pattern can be recognized

B: pattern can be recognized to some extent

C: pattern cannot be recognized (Non-Flat State)

Figure 13:
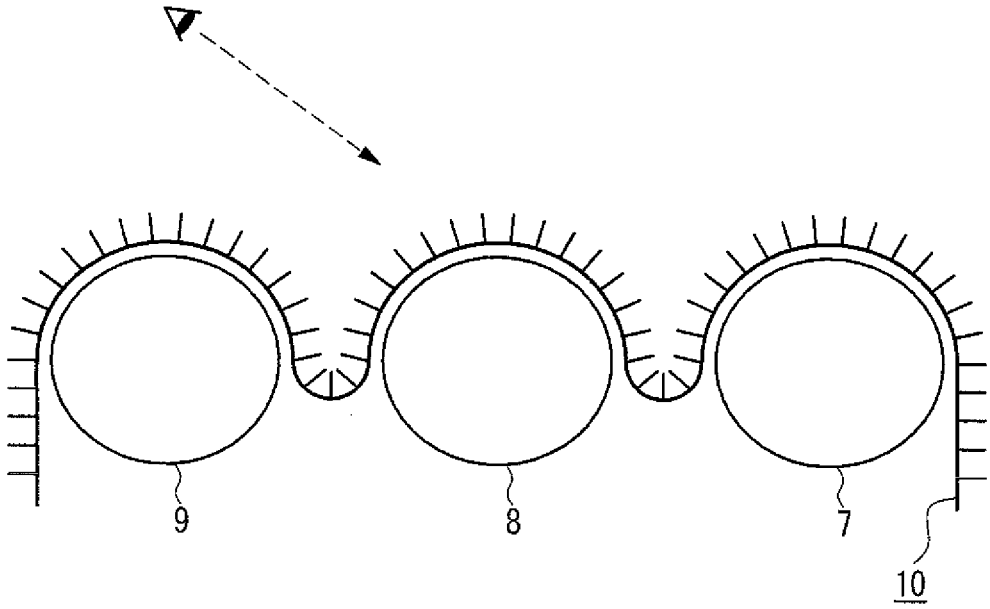
FIG. 13 is a schematic cross-sectional view showing a method for observing the pile knitted fabric of the present invention in a non-flat state.

As shown in FIG. 13, each pile knitted fabric 10 was arranged on three rolls 7, 8 and 9 of radiuses 50 mm (50R), 25 mm (25R) and 5 mm (5R) so that the piles of the pile fibers were parallel to the length direction of the rolls. Then, the stitch pattern in the non-flat state was observed from the pile fiber side and judged as follows. Arms, shoulders or legs of human bodies were assumed in this observation method. By a measurement like this, it is possible to judge whether the stitch pattern composed only of the ground structure can be seen or not by the motion or the like during wearing.

A: pattern can be recognized

B: pattern can be recognized to some extent

C: pattern cannot be recognized

Based on the observation results of the stitch patterns in the flat state and in the non-flat state, the designability was evaluated comprehensively in the following manner. The results were shown in Table 1 below.

(Comprehensive Evaluation)

With designability: the observation result of the stitch pattern in the flat state was B or C, and the observation result thereof in the non-flat state (bent by the roll of radius 25 mm) was A or B.

Without designability: the observation result of the stitch pattern in the flat state was A, or the observation results thereof in the flat state and in the non-flat state (bent by the roll of radius 25 mm) were C.

In the above, as to the pile knitted fabric whose pattern can be recognized in the flat state, the sewn product shows a state in which the pattern appears even in the static state. Therefore, the designability is low. Further, as to the pile knitted fabric whose pattern can be recognized or can be recognized to some extent in the non-flat state (bent by the roll of radius 50 mm), it shows excellent designability. When such a fabric is used in a body portion of a sewn product, the pattern appears in the body portion by the motion of a body or the sway of the wind, etc. Further, as to the pile knitted fabric whose pattern can be recognized or can be recognized to some extent in the non-flat state (bent by the roll of radius 25 mm), it shows excellent designability. When such a fabric is used in a sleeve portion of a sewn product, the pattern appears in the sleeve portion by the swing of arms while walking. Incidentally, as to the pile knitted fabric whose pattern can be recognized or can be recognized to some extent in the non-flat state (bent by the roll of radius 5 mm), it has low designability. When such a fabric is used in a sewn product, the pattern appears only in small wrinkles in a side portion or bent elbow portion.

TABLE 1

| | Pile length (mm) | Width of line of stitch pattern (mm) | Width of line of stitch pattern/ pile length | Width of pile fiber portion (mm) | Continuous length of line of stitch pattern (mm) | Continuous length of pile fiber portion (mm) | Angle of line of stitch pattern (°) | Stitch pattern | Designability | | | | |
|---|---|---|---|---|---|---|---|---|---|---|---|---|---|
| | | | | | | | | | | Bent | | | Comprehensive |
| | | | | | | | | | Flat | 50R | 25R | 5R | evaluation |
| Ex. 1 | 6 | 1.3 | 0.22 | 11.7 | 400 | 400 | 90 | stripe | B | B | A | A | with designability |
| Ex. 2 | 8 | 1.3 | 0.16 | 11.7 | 400 | 400 | 90 | stripe | C | C | B | A | with designability |
| Ex. 3 | 8 | 2.2 | 0.28 | 11.7 | 400 | 400 | 90 | stripe | B | B | A | A | with designability |
| Ex. 4 | 8 | 1.3 | 0.16 | 4.5 | 10 | 400 | 90 | houndtooth | C | C | B | A | with designability |
| Ex. 5 | 18 | 2.2 | 0.12 | 7.8 | 100 | 105 | 70 | herringbone | C | C | B | A | with designability |
| Ex. 6 | 18 | 4.0 | 0.22 | 7.8 | 100 | 105 | 70 | herringbone | B | B | A | A | with designability |
| Ex. 7 | 18 | 5.2 | 0.29 | 7.8 | 100 | 105 | 70 | herringbone | B | A | A | A | with designability |
| Ex. 8 | 25 | 2.3 | 0.09 | 22.0 | 19/10 | 27 | 40/90 | honeycomb | C | C | B | A | with designability |
| Ex. 9 | 25 | 3.3 | 0.13 | 22.0 | 19/10 | 27 | 40/90 | honeycomb | C | B | A | A | with designability |
| Ex. 10 | 25 | 4.7 | 0.19 | 22.0 | 19/10 | 27 | 40/90 | honeycomb | C | A | A | A | with designability |
| Ex. 11 | 25 | 6.0 | 0.24 | 22.0 | 19/10 | 27 | 40/90 | honeycomb | C | A | A | A | with designability |
| Ex. 12 | 8 | 1.3 | 0.16 | 1.5 | 400 | 10 | 90 | houndtooth | C | C | B | A | with designability |
| Ex. 13 | 25 | 6.0 | 0.24 | 30.0 | 50 | 50 | 20 | herringbone | C | C | B | A | with designability |
| Ex. 14 | 25 | 6.0 | 0.24 | 30.0 | 50 | 50 | 80 | herringbone | C | A | A | A | with designability |

TABLE 2

| | Pile length (mm) | Width of line of stitch pattern (mm) | Width of line of stitch pattern/ pile length | Width of pile fiber portion (mm) | Continuous length of line of stitch pattern (mm) | Continuous length of pile fiber portion (mm) | Angle of line of stitch pattern (°) | Stitch pattern | Designability | | | | |
|---|---|---|---|---|---|---|---|---|---|---|---|---|---|
| | | | | | | | | | | Bent | | | Comprehensive |
| | | | | | | | | | Flat | 50R | 25R | 5R | evaluation |
| Comp. Ex. 1 | 5 | 1.3 | 0.26 | 11.7 | 400 | 400 | 90 | stripe | A | A | A | A | without designability |
| Comp. Ex. 2 | 8 | 4.0 | 0.50 | 11.7 | 400 | 400 | 90 | stripe | A | A | A | A | without designability |
| Comp. Ex. 3 | 8 | 1.3 | 0.16 | 4.5 | 7 | 400 | 90 | houndtooth | C | C | C | B | without designability |
| Comp. Ex. 4 | 18 | 1.3 | 0.07 | 7.8 | 100 | 105 | 70 | herringbone | C | C | C | B | without designability |
| Comp. Ex. 5 | 18 | 6.5 | 0.36 | 7.8 | 100 | 105 | 70 | herringbone | A | A | A | A | without designability |
| Comp. Ex. 6 | 25 | 7.0 | 0.28 | 22.0 | 19/10 | 27 | 40/90 | honeycomb | A | A | A | A | without designability |
| Comp. Ex. 7 | 30 | 6.0 | 0.20 | 22.0 | 19/10 | 27 | 40/90 | honeycomb | C | C | C | A | without designability |
| Comp. Ex. 8 | 8 | 1.3 | 0.16 | 1.5 | 400 | 1 | 90 | houndtooth (3-stitch skip) | C | C | C | C | without designability |
| Comp. Ex. 9 | 8 | 1.3 | 0.16 | 1.5 | 400 | 8 | 90 | houndtooth | C | C | C | B | without designability |
| Comp. Ex. 10 | 25 | 6.0 | 0.24 | 30.0 | 50 | 50 | 0 | border | C | C | C | C | without designability |
| Comp. Ex. 11 | 25 | 6.0 | 0.24 | 30.0 | 50 | 50 | 10 | herringbone | C | C | C | B | without designability |

According to Table 1, in the pile knitted fabrics of Examples 1-14, the pile length is 6 to 25 mm, the width of the line of the stitch pattern is 1 to 6 mm, the ratio of the width of the line of the stitch pattern to the pile length is 0.09 to 0.30, the continuous length of the line of the stitch pattern is 10 mm or more, the angle of the line of the stitch pattern is 20° to 90°, the continuous length of the pile fiber portion is 10 mm or more. The stitch pattern composed only of the ground structure cannot be seen or noticed in the flat state as viewed from the pile fiber side but appears in the non-flat state. Therefore, it is shown that the pile knitted fabrics change widely and have excellent designability.

Further, according to the comparison between Examples 8-11, it is shown that when the pile length is uniform, the pile knitted fabric changes more as the width of the line of the stitch pattern becomes larger, thereby providing excellent designability. This is clear also from the comparison between Example 1 and Example 2, and the comparison between Examples 5-7.

On the other hand, in the pile knitted fabric of Comparative Example 1, the pile length is less than 6 mm, and the stitch pattern is observed even in the flat state as viewed from the pile fiber side. Therefore, it is shown that the pile knitted fabric changes little and has less designability. Further, in the pile knitted fabric of Comparative Example 7, the pile length exceeds 25 mm, and the stitch pattern cannot be observed even in the non-flat state (e.g., bent using the roll of radius 25 mm) as viewed from the pile fiber side. Therefore, it is shown that the pile knitted fabric changes little and has less designability In the pile knitted fabric of Comparative Example 2, the ratio of the width of the line of the stitch pattern to the pile length exceeds 0.30, and the stitch pattern is observed even in the flat state as viewed from the pile fiber side. Therefore, it is shown that the pile knitted fabric changes little and has less designability. Further, in the pile knitted fabric of Comparative Example 4, the ratio of the width of the line of the stitch pattern to the pile length is less than 0.09, and the stitch pattern cannot be observed even in the non-flat state (e.g., bent using the roll of radius 25 mm) as viewed from the pile fiber side. Therefore, it is shown that the pile knitted fabric changes little and has less designability.

In the pile knitted fabric of Comparative Example 3, the continuous length of the line of the stitch pattern is less than 10 mm, and the stitch pattern cannot be observed even in the non-flat state (e.g., bent using the roll of radius 25 mm) as viewed from the pile fiber side. Therefore, it is shown that the pile knitted fabric changes little and has less designability.

In the pile knitted fabric of Comparative Example 5, the width of the line of the stitch pattern exceeds 6 mm, the ratio of the width of the line of the stitch pattern to the pile length exceeds 0.30, and the stitch pattern is observed even in the flat state as viewed from the pile fiber side. Therefore, it is shown that the pile knitted fabric changes little and has less designability. Further, in the pile knitted fabric of Comparative Example 6, the width of the line of the stitch pattern exceeds 6 mm, and the stitch pattern is observed even in the flat state as viewed from the pile fiber side. Therefore, it is shown that the pile knitted fabric changes little and has less designability.

In the pile knitted fabrics of Comparative Examples 8 and 9, the continuous length of the pile fiber portion is less than 10 mm, and the stitch pattern cannot be observed even in the non-flat state (e.g., bent using the roll of radius 25 mm) as viewed from the pile fiber side. Therefore, it is shown that the pile knitted fabrics change little and have less designability.

In the pile knitted fabrics of Comparative Examples 10 and 11, the angle of the line of the stitch pattern is less than 20°, and the stitch pattern cannot be observed even in the non-flat state (e.g., bent using the roll of radius 25 mm) as viewed from the pile fiber side. Therefore, it is shown that the pile knitted fabrics change little and have less designability.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

Industrial Applicability

The pile knitted fabric of the present invention provides excellent designability and is useful as fake furs and the like.

DESCRIPTION OF REFERENCE NUMERALS

1 ground structure
2 pile fibers
3 napped portion
4 stitches composed only of the ground structure
5 backing resin
6 stitches into which pile fibers are knitted
7, 8, 9 rolls
10 pile knitted fabric
11 line of the stitch pattern composed only of the ground structure
12 pile fiber portion

The invention claimed is:

1. A pile knitted fabric comprising a ground structure and a pile fiber napped from the ground structure, the pile knitted fabric, including:

the pile fiber that is knitted into a stitch of the ground structure and napped therefrom; and a stitch composed only of the ground structure, wherein a pile length of the pile knitted fabric is 6 to 25 mm, a continuous length of a pile fiber portion where the pile fiber is knitted into the stitch of the ground structure and napped therefrom is 10 mm or more, a width of a line of a stitch pattern composed only of the ground structure is 1 to 6 mm, a continuous length of the line of the stitch pattern composed only of the ground structure is 10 mm or more, a ratio of the width of the line of the stitch pattern composed only of the ground structure to the pile length is 0.09 to 0.30, and when a weft direction of the pile knitted fabric is placed horizontally, an acute angle formed between the weft direction of the pile knitted fabric and the line of the stitch pattern composed only of the ground structure is 20° to 90°.

2. The pile knitted fabric according to claim 1, wherein the stitch pattern composed only of the ground structure cannot be seen or noticed in a flat state as viewed from a pile fiber side but appears in a non-flat state.

3. The pile knitted fabric according to claim 1, wherein the stitch composed only of the ground structure is 15 to 55% based on the total stitches.

4. The pile knitted fabric according to claim 1, wherein the pile knitted fabric is a sliver knit.

5. A sewn product employing a pile knitted fabric, including:

a pile fiber that is knitted into a stitch of a ground structure and napped therefrom; and a stitch composed only of the ground structure, wherein a pile length of the pile knitted fabric is 6 to 25 mm, a continuous length of a pile fiber portion where the pile fiber is knitted into the stitch of the ground structure and napped therefrom is 10 mm or more, a width of a line of a stitch pattern composed only of the ground structure is 1 to 6 mm, a continuous length of the line of the stitch pattern composed only of the ground structure is 10 mm or more, a ratio of the width of the line of the stitch pattern composed only of the ground structure to the pile length is 0.09 to 0.30, and when a weft direction of the pile knitted fabric is placed horizontally, an acute angle formed between the weft direction of the pile knitted fabric and the line of the stitch pattern composed only of the ground structure is 20° to 90°.

6. The pile knitted fabric according to claim 2, wherein the stitch composed only of the ground structure is 15 to 55% based on the total stitches.

7. The pile knitted fabric according to claim 2, wherein the pile knitted fabric is a sliver knit.

8. The pile knitted fabric according to claim 3, wherein the pile knitted fabric is a sliver knit.

9. The pile knitted fabric according to claim 6, wherein the pile knitted fabric is a sliver knit.

10. The sewn product according to claim 5, wherein, when a weft direction of the sewn product is placed horizontally, an acute angle formed between the weft direction of the sewn product and the line of the stitch pattern composed only of the ground structure is 20° to 90°.

11. The sewn product according to claim 5, wherein the stitch pattern composed only of the ground structure cannot be seen or noticed in a flat state as viewed from a pile fiber side but appears in a non-flat state.

12. The sewn product according to claim 5, wherein the stitch composed only of the ground structure is 15 to 55% based on the total stitches.

13. The sewn product according to claim 5, wherein the pile knitted fabric is a sliver knit.

* * * * *